United States Patent [19]

Burgert

[11] Patent Number: 4,621,989

[45] Date of Patent: Nov. 11, 1986

[54] SUPPORT DISC FOR PUMP DIAPHRAGM

[76] Inventor: Herwig Burgert, 40, Bismarckstrasse, 6300 Giessen, Fed. Rep. of Germany

[21] Appl. No.: 169,044

[22] Filed: Jul. 15, 1980

[30] Foreign Application Priority Data

Jul. 28, 1979 [DE] Fed. Rep. of Germany ..... 2930765

[51] Int. Cl.[4] ..... F04B 43/06

[52] U.S. Cl. ..... 417/383; 417/395

[58] Field of Search ..... 417/395, 383, 384, 385, 417/386, 387, 388, 389; 138/40

[56] References Cited

U.S. PATENT DOCUMENTS

| | | | |
|---|---|---|---|
| 1,503,371 | 7/1924 | Meyer | 138/40 |
| 2,825,203 | 3/1958 | Bertin et al. | 138/40 X |
| 3,052,188 | 9/1962 | Wolf et al. | 417/388 |
| 3,374,750 | 3/1968 | Hetz | 417/395 |
| 3,645,298 | 2/1972 | Roberts et al. | 138/40 |
| 3,878,869 | 4/1975 | Yamanouchi et al. | 138/40 |
| 3,983,903 | 10/1976 | Kuehn, Jr. | 138/40 |

*Primary Examiner*—Leonard E. Smith
*Attorney, Agent, or Firm*—Wells & Wells

[57] ABSTRACT

In a pumping apparatus having a flexible diaphragm a disc is arranged for supporting the diaphragm. The support disc has holes through which the pump liquid passes. For preventing the diaphragm from being drawn into the holes plugs are inserted in the holes in such a way that openings or slots are formed which are sufficiently wide for the liquid to flow therethrough but are not wide enough for the diaphragm to be sucked into the support disc. The diaphragm is thus prevented from becoming damaged. Various embodiments of suitable plugs are illustrated which either form the narrow openings in combination with the surrounding wall of the holes in the support disc or are provided with holes or slots in the plug body.

1 Claim, 10 Drawing Figures

SUPPORT DISC FOR PUMP DIAPHRAGM

BACKGROUND OF THE INVENTION

The present invention pertains to pumping apparatus with flexible diaphragms. More specifically the invention relates to support discs for supporting the flexible diaphragm in such apparatus.

In this particular art it is well known to provide a support disc on one side of the pump diaphragm for preventing the diaphragm from being drawn into the pump cylinder wherein the piston undergoes its forward and backward motion. This is in more detail described, for example, in the U.S. Pat. No. 2,345,693, the disclosure of which is incorporated herein by reference.

The support discs are provided with holes to allow the pump liquid to flow freely through the discs and exert a pulsating pressure on the diaphragm under the influence of the backward and forward motion of the piston. The holes usually have a diameter ranging from approximately 3 to 10 millimeters.

However, it is a disadvantage of such a support disc that the diameter of the holes is too large in order to really prevent the diaphragm from becoming damaged, even if such diameter should only be 3 millimeters. The diaphragm which may only be 0.25 millimeters thick may still be drawn inwardly by the piston and may thus be destroyed. This, of course, would lead to a sudden break down of the pump. Replacing the diaphragm would then be both costly and time consuming.

This disadvantage could, of course, be readily overcome by reducing the diameter of the holes to, for example, 0.5 millimeters. However, in order not to disturb the free pulsation of the pump liquid through the disc a great number of 0.5 millimeter holes or slots would have to be provided in the support disc. This, on the other hand, represents a further disadvantage. Drilling a great number of 0.5 millimeter holes through a disc which may well be 2 millimeters thick is very difficult and so is the cutting or milling of 0.5 millimeter wide slots.

It is therefore the object of the invention to provide a support disc having a large number of narrow holes or slots which is still easy to manufacture.

SUMMARY OF THE INVENTION

According to the invention the above stated object is attained by providing in the disc a plurality of holes having a greater diameter. This diameter is stepped with the larger diameter end of the hole facing the support disc. Plugs are secured in the holes; these plugs also have a stepped diameter but their large diameter is slightly smaller than the large diameter of the holes. This defines a very narrow ring between the plug and the hole wall which may have only a width of 0.5 millimeters. From the opposite side of the support disc holes are drilled half into the plugs and half into the hole edge down to the stepped area of the holes and the plugs. This enables the pump liquid to pass through the open holes and the open ring and thus pulsate through the support disc. The ring is of such a narrow width that the diaphragm cannot be drawn into the pump cylinder. At the same time the openings are wide enough to allow the pump liquid to pass freely through the support disc.

To facilitate the liquid flow the plug may be provided with a groove surrounding its outer cylinder.

Further according to the invention, the object is also attained by providing holes in the disc and securing cup-shaped plugs therein. The bottoms of the plugs are provided with narrow holes through which the pump liquid passes. The cup bottoms are thin compared to the thick support disc so that it is easy to drill narrow holes therethrough.

Further, the object of the invention may also be attained by providing holes in the disc and securing plugs therein which consist of a bundle of narrow tubes. The tubes are held together by a ring and the space between the tubes is filled with a suitable material.

BRIEF DESCRIPTION OF THE DRAWINGS

The invention will be more readily comprehended from the following description when taken in conjunction with the appending drawings, wherein.

DESCRIPTION OF THE PREFERRED EMBODIMENTS

Figure 1:
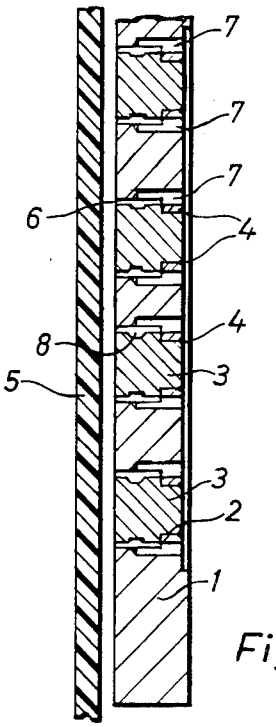
FIG. 1 shows schematically a sectional view of the diaphragm with a support disc arranged next to the diaphragm.
Figure 2:
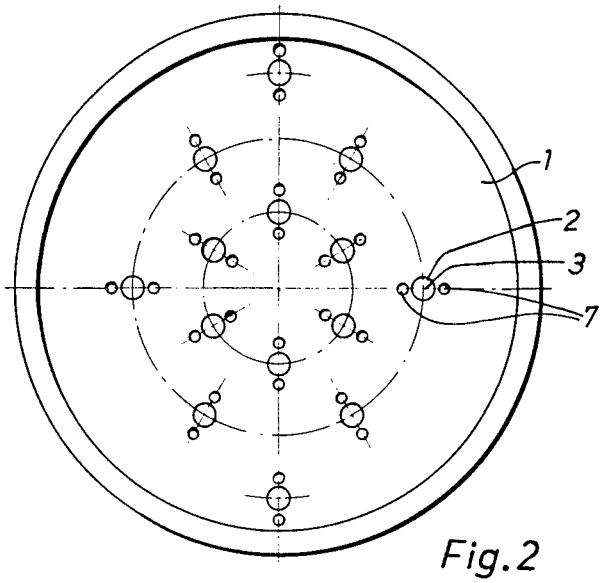
FIG. 2 is a side view of FIG. 1 from the right.

Referring now to the drawings, in the FIGS. 1 and 2 there is shown a support disc 1 having holes 2 of approximately 6 millimeters diameter. Plugs 3 of about the same thickness as the support disc 1 are pressed into the holes and are therein secured by blows with a center punch.

On the side of the diaphragm 5 the holes 2 have a sightly larger diameter of approximately 9 millimeters. On the same side the plugs 3 are also of a larger diameter, for example of 8 millimeters. By this difference of diameters an annular slot 6 of about 0.5 millimeters width is formed. From the opposite side of the support disc small holes 7 are drilled down to this annular slot 6. Through these holes 7 and the annular ring passes the pump liquid freely through the support disc. Additionally an annular groove 8 is provided in the plug on the same level with the end of the holes 7.

Figure 3:
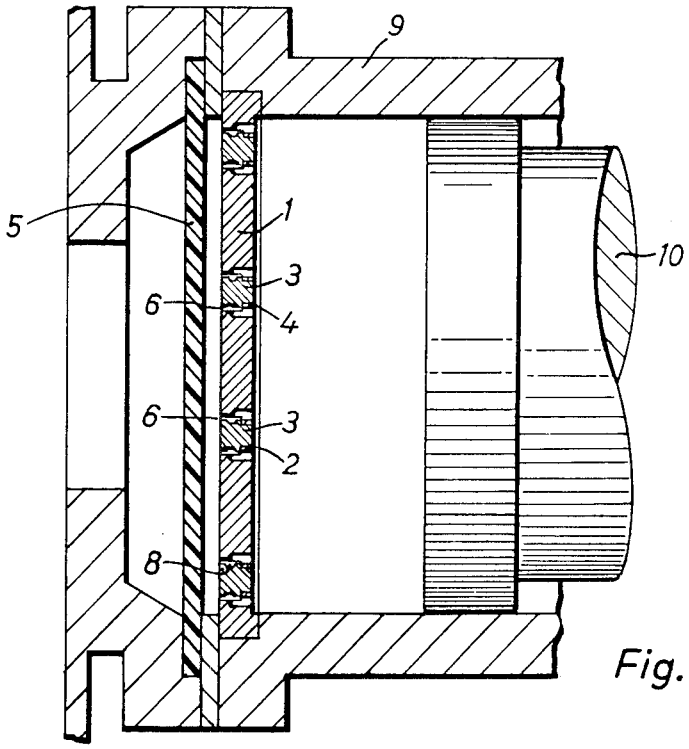
FIG. 3 shows schematically a part of a liquid-handling pump with the diaphragm and the support disc.

As shown in FIG. 3 the support disc of the FIGS. 1 and 2 is mounted in a pump cylinder 9 in such a way that on the right-hand side of the support disc the pump piston 10 executes its back and forward motion while the diaphragm is arranged on the opposite side.

In the prior art embodiments the diaphragm was usually drawn into the holes 2 each time the piston performed its backward stroke because the holes 2 were open. This caused in time the destruction of the diaphragm. In the embodiment according to the invention, however, the diaphragm is drawn against and supported by the plug 3. The diaphragm cannot be drawn into the narrow annular slot 6 and is thus protected against becoming damaged.

The annular slot represents a certain resistance against the flow of the pump liquid; therefore the annular groove 8 is provided in the outer cylinder of the plug in order to reduce the length of the slot in axial direction as much as possible.

The above described embodiment has been developed for a diaphragm pump operating at a pressure of about 1,000 bar and having a diaphragm which is approximately 0.25 millimeter thick.

Figure 4:
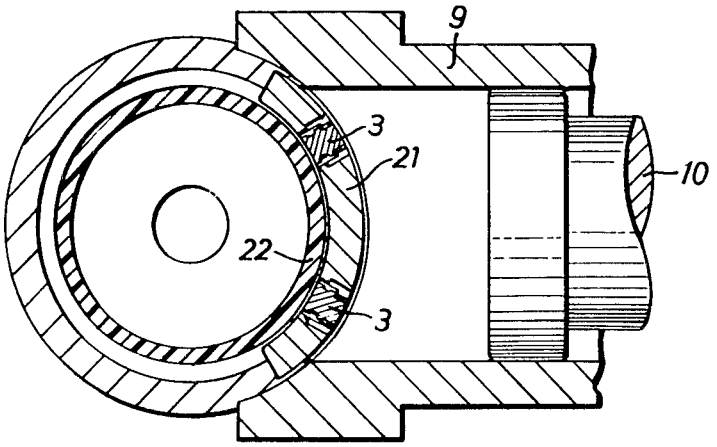
FIG. 4 shows a sectional view of a pump portion with a pump tube and a bent support disc adjacent the tube, FIGS. 5; 6 show a cup-shaped plug having slots in the cup bottom.

The embodiment of FIG. 4 shows a support disc 21 which is bent to fit against the outer surface of a pump tube 22.

Figure 5:
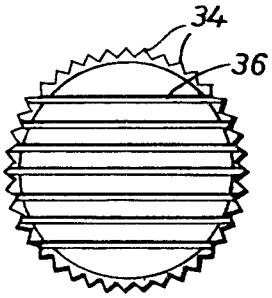
Figure 6:
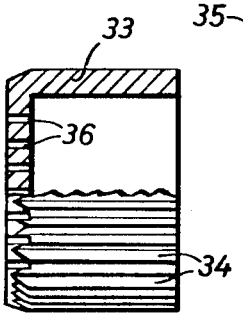
Figure 7:
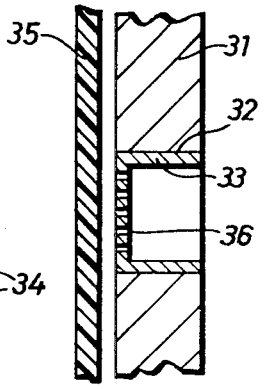
FIG. 7 shows the plug of the FIGS. 5 and 6 inserted in a hole of a support disc, FIGS. 8; 9 show a plug consisting of a bundle of narrow tubes.

In pumps operating at a lower pressure simplified embodiments may be applied, as for example, shown in the FIGS. 5; 6; 7 and 8; 9; 10.

In the FIGS. 5; 6 and 7 a cup-shaped plug 33 is shown which is pressed into the support disc 31 with the cup bottom adjacent the diaphragm 33. The outer cylinder of the plug 33 is provided with a saw-toothed knurl 34. When the plug is pressed into the hole 32 the knurl 34 secures a safe seat of the plug in the support disc. The bottom of the plug has slots 36 through which the pump liquid passes. According to the operating pressure and the nature of the liquid, for example water or oil, the slots may have a width up to 0.2 millimeters.

Figure 8:
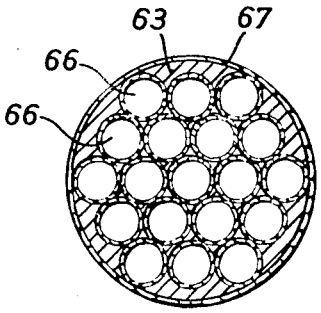
Figure 9:
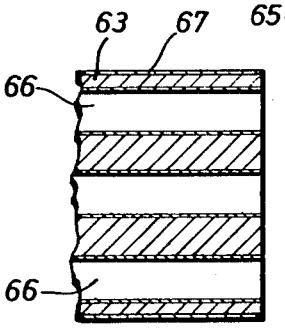
Figure 10:
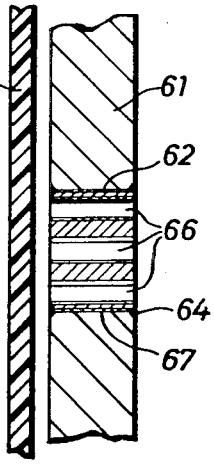
FIG. 10 shows the plug of the FIGS. 8 and 9 inserted in a hole in the support disc.

In the embodiment shown in the FIGS. 8; 9 and 10 the plug consists of a bundle of narrow tubes 66 which are held together by a ring 67. The ring is secured in the hole 62 by impressions provided by a blow with a center punch. The space between the tubes is filled with a suitable material 63. In this Figure the diaphragm is designated by the numeral 65.

What is claimed is:

1. A support disc for supporting the flexible diaphragm of a liquid-handling pump, said disc having holes extending therethrough, wherein the improvement comprises:

plugs secured in said holes, said plugs having a shape defining an opening between the outer plug surface and the surrounding hole in the disc wall, said opening being sufficiently wide to allow liquid from said pump to pass therethrough and being sufficiently narrow to prevent said diaphragm from being drawn into said pump; and (a) said holes having a diameter stepped so that the holes have a larger diameter on the side facing the diaphragm;

(b) said plugs have an accordingly stepped diameter to fit in said holes, the large plug diameter being smaller than the large diameter of the holes so that an open ring exists between the disc wall and the outer plug surface;

(c) second holes drilled half into the disc material and half into the plug material from the side of the smaller hole diameter, the second holes being drilled down to a level of the diameter step; and (d) a groove in the outer cylinder surface of the plugs at the level of the end of the second holes;

the open ring and the groove and the second holes forming together the opening which allows liquid of said pump to pulsate freely through the disc and which at the same time prevents said diaphragm from being drawn into said pump.

* * * * *